United States Patent [19]

Arai et al.

[11] Patent Number: 4,980,276

[45] Date of Patent: Dec. 25, 1990

[54] NEGATIVE SILVER HALIDE PHOTOGRAPHIC LIGHT-SENSITIVE MATERIAL CAPABLE OF BEING HANDLED IN LIGHT ROOM

[75] Inventors: Takeo Arai, Hachioji; Toshiharu Nagashima, Hino, both of Japan

[73] Assignee: Konica Corporation, Tokyo, Japan

[21] Appl. No.: 512,596

[22] Filed: Apr. 24, 1990

Related U.S. Application Data

[63] Continuation of Ser. No. 206,364, Jun. 14, 1988, abandoned.

[30] Foreign Application Priority Data

Jun. 18, 1987 [JP] Japan ..... 62-153156

[51] Int. Cl.[5] ..... G03C 1/36

[52] U.S. Cl. ..... 430/606; 430/510; 430/517; 430/519; 430/522; 430/598

[58] Field of Search ..... 430/510, 517, 519, 522, 430/598, 606

[56] References Cited

U.S. PATENT DOCUMENTS

| | | | |
|---|---|---|---|
| 3,201,249 | 8/1965 | Pierce et al. | 430/517 |
| 3,431,111 | 3/1969 | Brooker et al. | 430/606 |
| 3,767,651 | 10/1973 | Chapman . | |
| 4,221,864 | 10/1980 | Iytaka et al. | 430/572 |
| 4,666,827 | 5/1987 | Sumi et al. | 430/567 |
| 4,737,452 | 4/1988 | Kameoka et al. | 430/600 |

FOREIGN PATENT DOCUMENTS

| | | |
|---|---|---|
| 0057933 | 8/1982 | European Pat. Off. . |
| 0219010 | 4/1987 | European Pat. Off. . |
| 1547642 | 12/1969 | Fed. Rep. of Germany . |
| 2528777 | 1/1976 | Fed. Rep. of Germany . |

*Primary Examiner*—Paul R. Michl
*Assistant Examiner*—Janet C. Baxter
*Attorney, Agent, or Firm*—Finnegan, Henderson, Farabow, Garrett, and Dunner

[57] ABSTRACT

A silver halide light-sensitive photographic material having an improved safe-light insensitivity and, therefore, capability of being easily handled in the light room is disclosed. The material comprises a support; at least one silver halide emulsion layer being provided on one side of the support and containing silver halide grains containing at least 50 mol % of silver chloride, $10^{-4}$ to $10^{-8}$ mol per 1 mol of silver halide of a rhodium salt and a desensitizing dye; and at least one hydrophilic colloidal layer being provided on the other side of the support and containing at least one dye so that the absorbancy of the dye at the maximum spectral sensitivity wavelength (λmax) of the densenitizing dye is not less than 0.3 and the absorbance ratio at the maximum spectral sensitivity wavelength against that at 450 nm is not less than 0.2.

6 Claims, 1 Drawing Sheet

NEGATIVE SILVER HALIDE PHOTOGRAPHIC LIGHT-SENSITIVE MATERIAL CAPABLE OF BEING HANDLED IN LIGHT ROOM

This application is a continuation of application Ser. No. 07/206,364, filed June 14, 1988, now abandoned.

FIELD OF THE INVENTION

The present invention relates to a negative silver halide photographic light-sensitive material, in particular, to a negative silver halide photographic light-sensitive material capable of being processed in an environment that can be called an "illuminated room", or "light room".

BACKGROUND OF THE INVENTION

For the purposes of labor-saving, improved operation efficiency, and prevention of environmental contamination, there has been a demand for a technique that will enable the film-making conventionally performed in a dark room i.e. the so-called "reverse process" to be performed in an illuminated room, whereby there have been improvements in light-sensitive materials as well as hardware such as a printer.

Such light-sensitive materials capable of being handled in an illuminated room include silver halide photographic light-sensitive materials that can be exposed by ultraviolet-rich light sources such as a high-voltage mercury-vapor lamp, metal halide light source, xenon lamp, and halogen lamp.

These silver halide photographic light-sensitive materials can be handled in a bright environment having an illumination of 100 to 500 luxes, as with a fluorescent lamp for general use, a fluorescent lamp of smaller ultraviolet emission designed for this purpose, or a fluorescent lamp of which ultraviolet emission being eliminated.

The known methods for preparing silver halide photographic light-sensitive materials being capable of handled in an illuminated room (hereinafter referred to as "sensitive materials for use in an illuminated room") are as follows: a method described for example in Japanese Patent Publication Open to Public Inspection (hereinafter referred to as Japanese Patent O.P.I. Publication) No. 125734/1981, wherein an inorganic desensitizer such as rhodium salt, and bismuth salt is added to an emulsion of high chloride content; a method described for example in Japanese Patent Examined Publication No. 17273/1970, wherein an organic desensitizer is added to an emulsion of high chloride content; a method described for example in Japanese Patent O.P.I. Publication Nos. 157633/1984, and 26041/1986, wherein rhodium salt or an organic desensitizer is added to an emulsion of high silver chloride content.

Recently, conflicting requirements of higher sensitivity, and a longer allowable duration where the light-sensitive material is handled, are required of a sensitive material for use in an illuminated room. As a result of researches for satisfying these conflicting criteria, the inventors have confirmed that a conventional method where rhodium salt, and organic desensitizer, in particular, a desensitizing dye, are added to an emulsion of which silver halide content comprising virtually silver chloride alone is favorable. However, it was learned that an illuminated room sensitive material prepared by such a method has the following disadvantages.

Usually, a light-sensitive material for use in an lluminated room is, in order to prevent halation, provided with a hydrophilic colloid backing layer containing a dye that has a spectral absorption range in a characteristic spectral range in the silver halide, and it has been a common knowledge that a safelight insensitivity of a sensitive material in an illuminated room is better when the backing layer positioned upward. However, with a sensitive material for use in an illuminated room containing a desensitizing dye, the safelight insensitivity deteriorates when the backing surface facing upward is irradiated with a safelight, though the safelight insensitivity of such a material is significantly greater when the emulsion layer side of such a material facing upward is irradiated with a safelight.

Such loss in safelight insensitivity is particularly manifest, when the sensitive material undergone exposure is irradiated with a safelight. This phenomenon is considered that while a latent image formed by exposing is oxidated with a desensitizing dye when irradiated with a safelight, while the characteristic sensitivity of silver halide decreases due to filtering effect of a bucking dye, thereby the enhancement for the latent image with safelight irradiation decreases.

SUMMARY OF THE INVENTION

An object of the present invention is to provide a highly sensitive negative silver halide photographic light-sensitive material that can be handled for an extended period in an illuminated room.

The other object of the invention is to provide a negative silver halide photographic light-sensitive material that can be handled for a sufficiently long period in an illuminated room regardless of which face of the material being exposed to the illuminated room environment.

The objects of the present invention above are achieved by a negative silver halide photographic light-sensitive material comprising a support provided thereon at least one silver halide emulsion layer, and on the other side of support, at least one hydrophilic colloid backing layer, in particular, by a negative silver halide photographic light-sensitive material characterized in that the emulsion layer contains silver halide grains comprising at least 50 mol % of silver chloride, and rhodium salt at a rate of $10^{-4}$ to $10^{-8}$ mol per mol silver halide, as well as a desensitizing dye, and in that the backing layer contains at least one type of dye so that absorbency of the desensitizing dye mentioned above at the maximum spectral sensitivity wavelength ($\lambda$max) should be not less than 0.3 and the ratio of the absorbency of this desensitizing dye at the maximum spectral sensitivity wavelength to the absorbency at 450 nm is not smaller than 0.2.

A hydrophilic colloid layer, in adjacency with the emulsion layer above, is formed in compliance with a specific requirement, and can be either a negative silver halide photographic emulsion layer or a non-light-sensitive layer. The exmaples of a non-light-sensitive layer include a subbing layer, intermediate layer, and a protective layer.

DETAILED DESCRIPTION OF THE INVENTION

Figure 1:
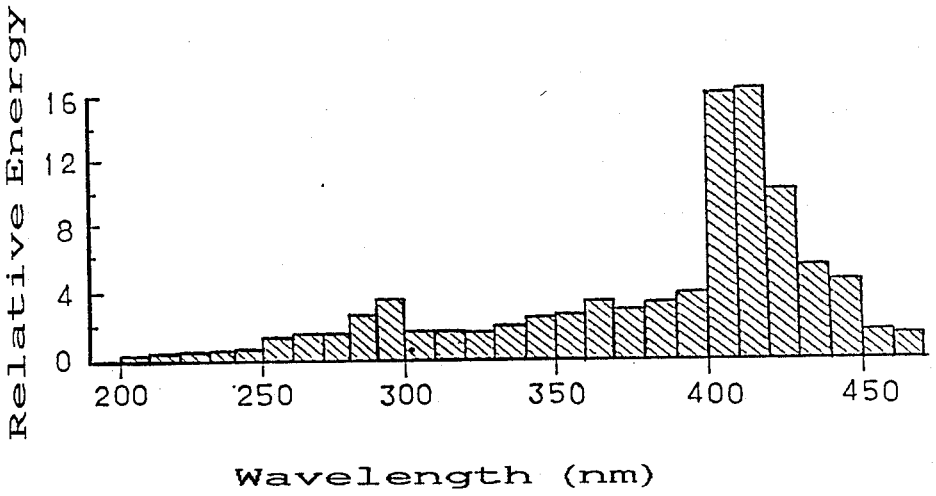
FIG. 1 is a graph illustrating the characteristics of an electrodeless discharge tube manufactured by Fusion Co.

The silver halide composition for forming at least onelayer of the negative silver halide photographic light-sensitive material of the invention comprises at least 50 mol % silver chloride. The particularly preferred silver halide components are silver chloride and silver chloro-bromide. The preferable average grain size of the emulsion is preferably less than 0 .5μ, and more preferably less than 0.3μ. These grains may be "Lippmann type" of less than 0.1μ. Various methods for preparing such super-fine silver halide grains are known in the art, and any of which may be arbitrarily used. However, more specifically, the preferred method is "functional-addition controlled double jet process", wherein rates for adding silver nitrate and halide are varied in proportion to the growth rate of silver halide grains formed in a reaction vessel at a comparatively low temperature, while the electrical potential of silver is maintained constant level where the solubility of grains is lowest i.e. 120 to 210 mV. Additionally, the pH level while silver halide is generated in a reaction vessel is an arbitrary level; however, in terms of pH level, the preferred method is an acid process where pH level ranges from 1 to 4. Furthermore, it is also a preferred mode of forming the silver halide grains according to the invention that in order to lower solubility of silver halide grains, silver halide in a reaction vessel is allowed to adsorb a nucleoside typified by adenine, benzyladenine, and adenocyine; or a tetrazaindene compound; or a mercapto compound.

Incidentally, through this specification, the size of silver halide grain is represented, for convenience, as an edge length of a cubic grain having volume same as the silver halide grain of the invention.

The emulsion mentioned previously contains rhodium salt at a rate of $10^{-4}$ to $10^{-8}$ mol per mol silver halide.

To add rhodium salt to the emulsion, various rhodium salts can be used. For example, the water-soluble rhodium salt used in embodying the invention is selected from conventionally known similar salts; the typical useful rhodium salts include [$Na_3Rhcl_6$], [$K_3RhBr_6$], rhodium chloride-amine complex, and rhodium trichloride.

The amount of rhodium salt to be added is preferably $10^{-4}$ to $10^{-8}$ mol per 1 mol of silver halide.

A water soluble rhodium salt being used is preferably employed, particularly, when silver halide grains are generated. However, such a salt may be used thereafter, or in several steps.

Other than into the emulsion metioned above, the rhodium salt is incorporated into a layer other than the emulsion layers formed with this emulsion, for example, an arbitrary hydrophilic colloid layer in the side where silver halide emulsion layer is formed. Additionally, the rhodium salt may be separated into several parts which are added to more than two layers.

When incorporating the rhodium salt, other inorganic compounds such as iridium salt, platinum salt, thalium salt, cobalt salt, and gold salt may be additionally used.

A mono-dispersity of silver halide grains contained in the emulsion above is arbitrarily selected; otherwise, preferably, adjusted to 5 to 60, in particular, 8 to 30.

The mono-dispersity is indicated by a value obtained by multiplying 100 times a value obtained by dividing the standard deviation of the above defined grain size by an average grain size.

For the silver halide grains in the emulsion mentioned above, grains having multilayer structure comprising at least two layers can be used. The examples of such useful grains include silver chloro-bromide grains comprising silver chloride cores and silver bromide shells; and the similar grains comprising silver bromide cores and silver chloride shells. Regardless of the nature of grains, it is mandatory that a silver chloride content in an emulsion be not less than 50 mol %. Additionally, an arbitrary layer can contain iodide. However, the preferred ratio of iodide in every layer is not more than 5 mol %.

A desensitizing dye useful in achieving the objects of the invention is preferably a compound of which sum of an anode potential and a cathode potential is positive when analyzed by polarography. This type of compounds are described in various patent specifications and literatures, and any of these desensitizing dyes is useful. However, the particularly preferred useful desensitizing dyes are those represented by the following general formulas [I] through [VI].

These compounds can be synthesized by referring to specifications of U.S. Pat. Nos. 3,567,456, 3,615,639, 3,579,345, 3,615,608, 3,598,596, 3,598,955, 3,592,653, and 3,582,343; Japanese Patent Examined Publication Nos. 26751/1965, 27332/1965, 13167/1968, 8833/1970, and 8746/1972.

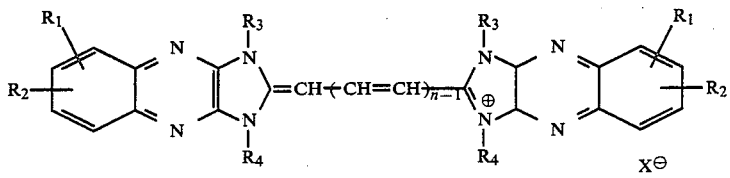

Formula [I]

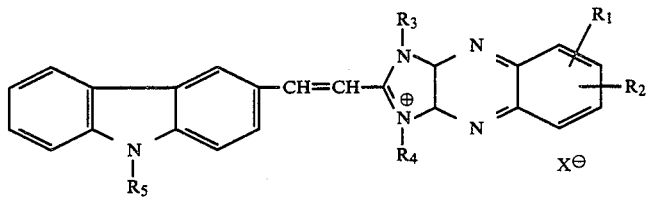

Formula [II]

In formulas [I] and [II], $R_1$ and $R_2$ independently represent a hydrogen atom, a halogen atom, a cyano group, a nitro group, an alkyl group (e.g., —$CF_3$), or a group necessary to complete a fused aromatic ring.

$R_3$ and $R_4$ independently represent an alkyl group, lower alkenyl group, phenyl group or lower hydroxylalkyl group. When neither $R_1$ nor $R_2$ is a hydrogen atom, $R_3$ and $R_4$ may independently be an aryl group. n is a positive integer from 1 to 4. $R_5$ represents a lower alkyl group or lower sulfonated alkyl group, and X represents an acid anion.

Formula [III]

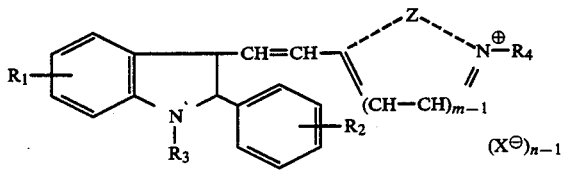

In formula [III], $R_1$ and $R_2$ independently represent a hydrogen atom or nitro group; and $R_3$ and $R_4$ independently represent lower alkyl group, allyl group or phenyl group. Z represents a group of atoms necessary for forming a nitrobenzothiazole nucleus, nitrobenzoxazole nucelus, nitrobenzoselenazole nucleus, imidazo[4.5-b]quinoxaline nucleus, 3.3-dimethyl-3H-pyrrolo[2.3-b]pyridinenucleus, 3.3-dialkyl-3H-nitroindole nucleus, thiazolo[4.5-b]quinoline nucleus, nitroquinoline nucleus, nitrothiazole nucleus, nitronaphthothiazole nucleus, nitroxazole nucleus, nitronaphthoxazole nucleus, nitroselenazole nucleus, nitronaphthoselenazole nucleus, or nitropyridine nucleus. X represents an anion; m and n independently represent an integer, 1 or 2. When the compound has an inner salt, n is 1.

Formula [IV]

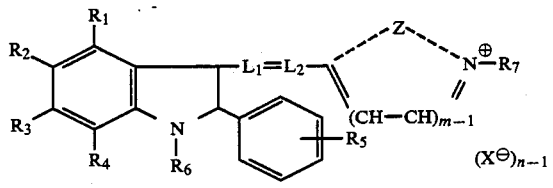

In formula [IV], $R_1$, $R_2$, $R_3$ and $R_4$ independently represent a hydrogen atom, halogen atom, alkyl group, alkoxy group, aryloxy group, or nitro group. $R_5$ represents a hydrogen atom, alkyl group, or nitro group. Z represents a group of atoms necessary for forming a thiazole nucleus, benzothiazole nucleus, naphthothiazole nucleus, oxazole nucleus, benzoxazole nucleus, naphthoxazole nucleus, selenazole nucleus, benzoselenazole nucleus, naphthoselenazole nucleus, thiazoline nucleus, pyridine nucleus, quinoline nucleus, isoquinoline nucleus, 3,3-dialkyl-3H-indole nucleus, imidazole nucleus, benzimidazole nucelus or naphthoimidazole nucleus, wherein each nucleus may be unsubstituted or have such a substituent as a lower alkyl group, phenyl group, thienyl group, halogen atom, alkoxy group, hydroxy group, cyano group, alkylsulfonyl group, alkoxycarbonyl group, phenylsulfonyl group and trifluorometyl group. $L_1$ and $L_2$ respectively represent a methine chain that may be unsubstituted or lower alkyl-substituted or aryl-substituted. $R_6$ and $R_7$ independently represent an alkyl group, alkenyl group, aryl group, sulfoalkyl group or aralkyl group, each being unsubstituted or substituted. X represents an anion; and m and n are independently 1 or 2. When the compound has an inner salt, n is 1.

Formula [V]

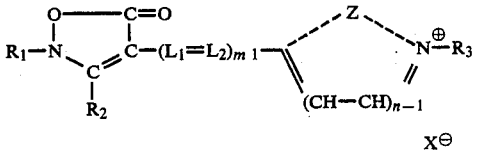

In formula [V], $R_1$ and $R_3$ independently represent an alkyl group; and $R_2$ represents an aryl group. $L_1$ and $L_2$ independently represent a methine chain that is unsubstituted or lower alkyl-substituted or aryl-substituted. Z represents a group of atoms necessary for forming a thiazole nucleus, benzothiazole nucleus, naphthothiazole nucleus, oxazole nucleus, benzoxazole nucleus, naphthoxazole nucleus, selenazole nucleus, benzoselenazole nucleus, naphthoselenazole nucleus, thiazoline nucleus, pyridine nucleus, quinoline nucleus, 3,3-dialkylindolenine nucleus, imidazole nucleus, or imidazo[4.5-b]quinoxaline nucleus. X represents an anion. m represents a positive integer 1 to 3, and n represents 1 or 2.

The typical examples of compounds expressed by the above formulas [I] through [V] are as follows. Also, it is to be understood that the scope of the invention is not limited to these compounds. In some of the following compounds, Pts ⊖ represents a paratoluenesulfonic acid anion.

(Example compounds)

(1)

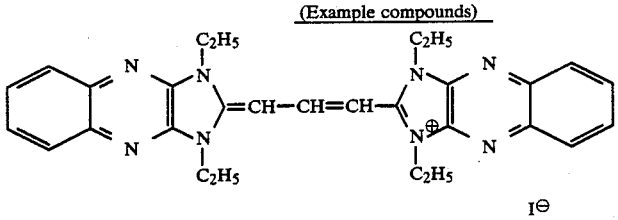

(2)

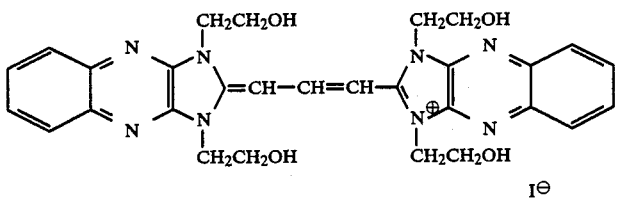

-continued
(Example compounds)
(3)
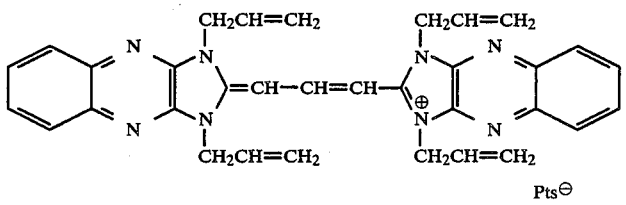
(4)
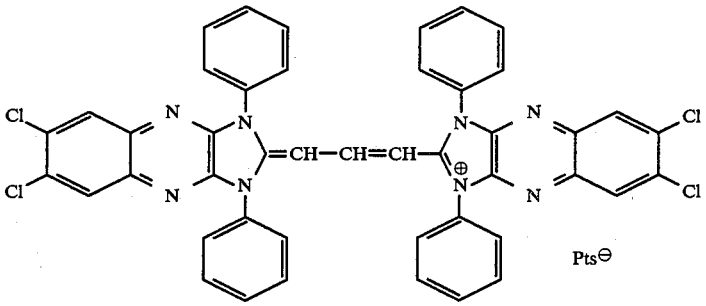
(5)
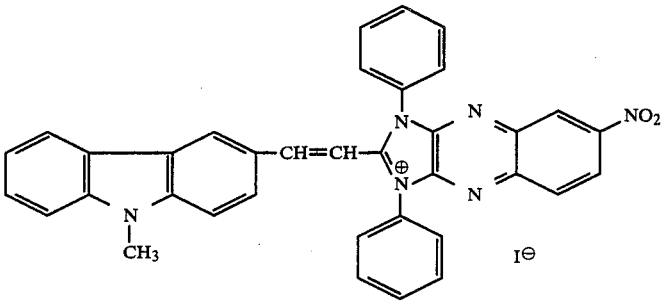
(6)
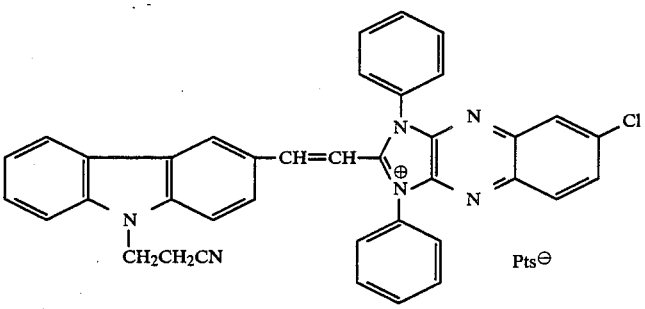
(7)
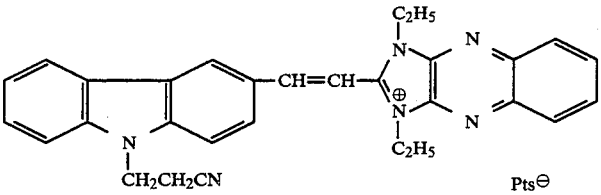
(8)
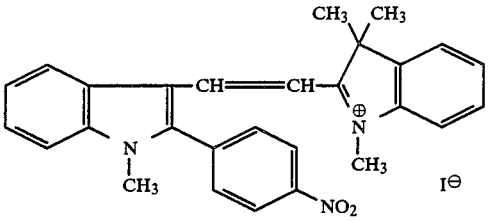

-continued
(Example compounds)
(9)
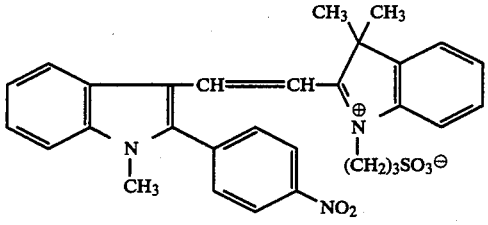
(10)
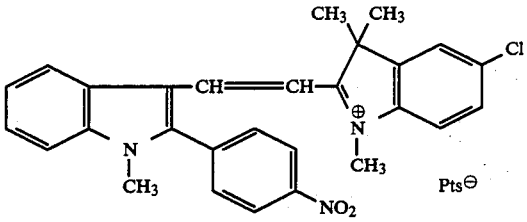
(11)
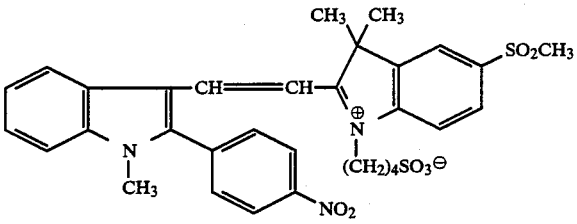
(12)
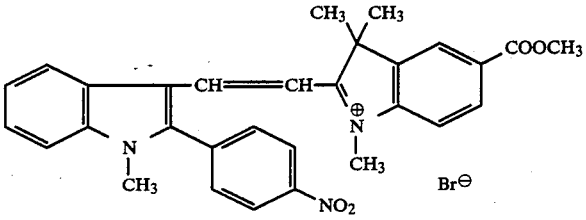
(13)
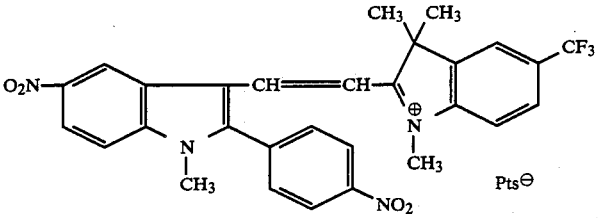
(14)
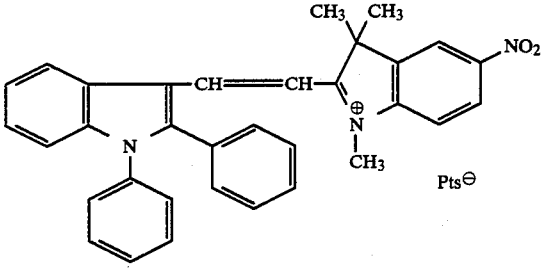

-continued
(Example compounds)
(15)
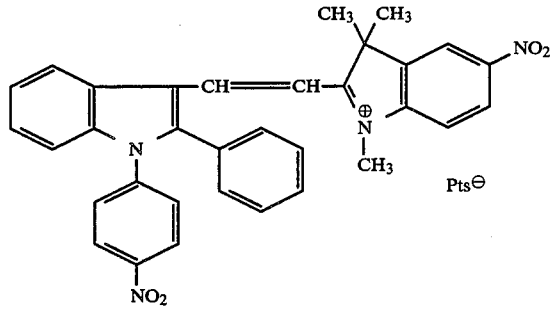
(16)
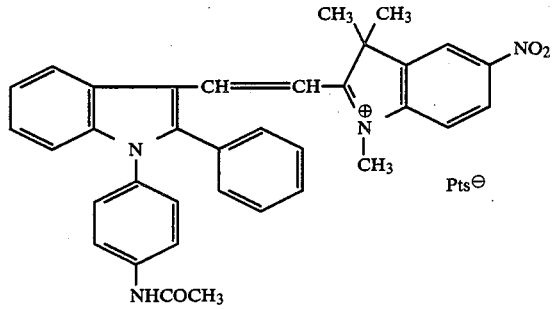
(17)
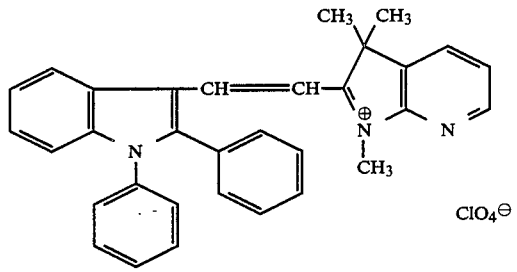
(18)
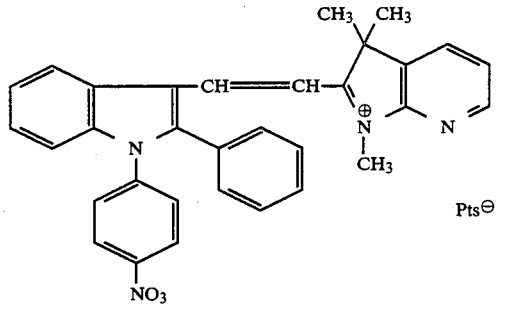
(19)
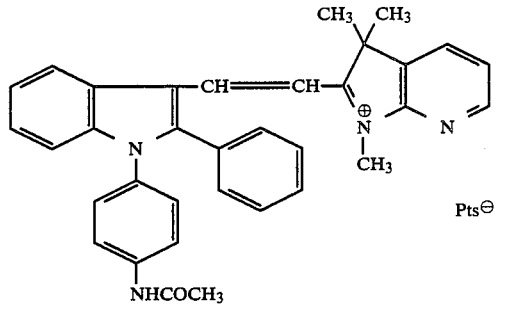

-continued
(Example compounds)
(20)
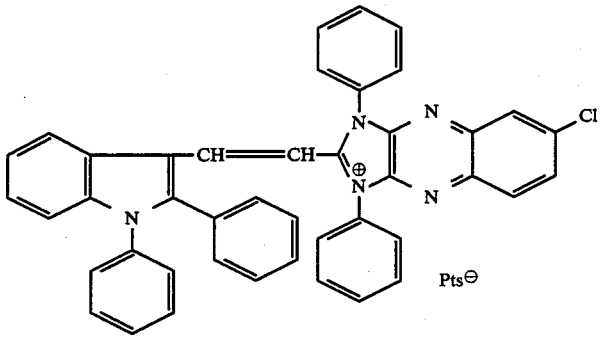
(21)
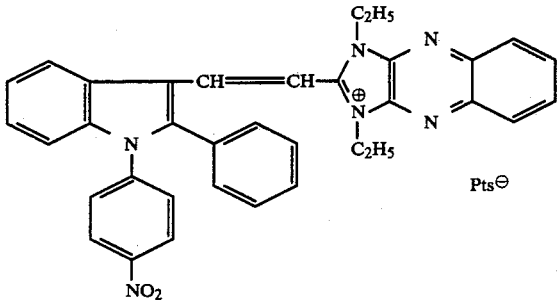
(22)
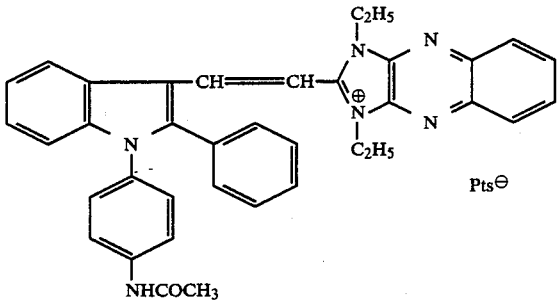
(23)
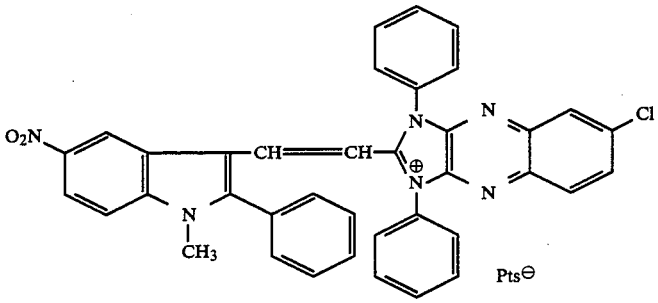
(24)
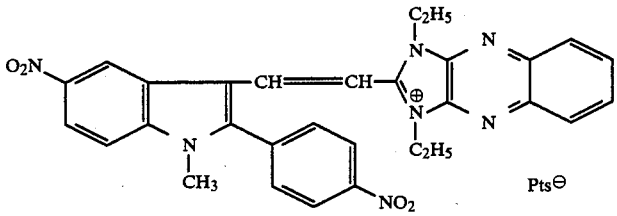

-continued (Example compounds)

(25)

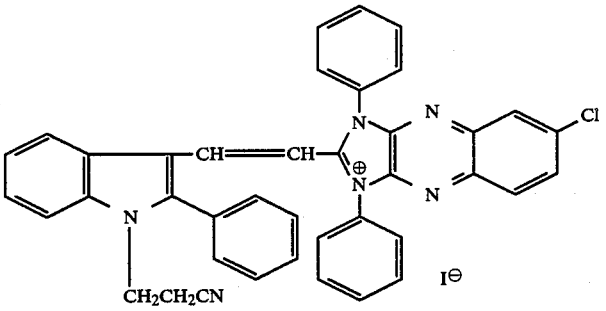

(26)

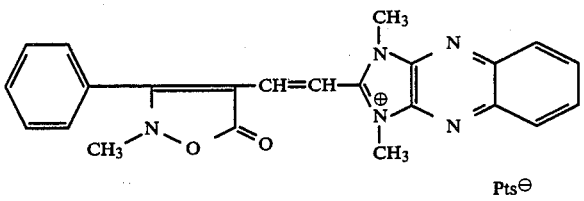

(27)

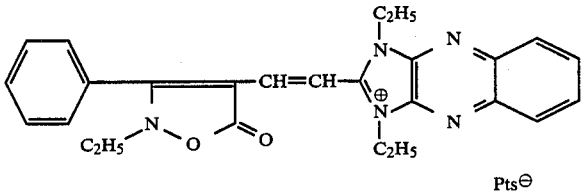

A desensitizing dye according to the invention is preferably used at a rate of 1 to 1,000 mg per mol silver halide, and, in particular, in a range of 5 to 300 mg per mol silver halide. The desensitizing dye of the invention may be incorporated into a light-sensitive material at any timing selected from during formation of silver halide grains, during physical ripening, during chemical ripening, after the ripening, or during preparation of a coating solution. Further, in order to prevent loss in the sensitivity, the desensitizing dye of the invention is a dye having low sensitivity in the 450 nm range and below, and of which maximum spectral sensitivity wavelength is higher than 500 nm.

A silver halide emulsion used in the present invention is a negative type one, and not of positive type. The negative silver halide emulsion differs from the positive type one in that it has grains fogged in advance. The effects of the invention are promoted by chemical ripening. An arbitrary method for chemical ripening is used as far as it is within the scope of preparing the above-defined negative emulsion.

Into the backing layer of a silver halide photographic light-sensitive material of the invention, various dyes may be incorporated. However, the type and amount of addition of a desensitizing dye should be determined so that the absorbency of the desensitizing dye at the maximum spectral sensitivity wavelength (hereinafter related to as λmax) is higher than 0.3, preferably, higher than 0.5. At the same time, the type and amount of addition should be also determined so that the ratio of an absorbency at λmax to an absorbency at 450 nm is greater than 0.2. The absorption wavelength and absorbency of a backing layer can be determined by forming the similar backing layer on a transparent polyester film, thereby obtaining data using a spectral actinometer.

The examples of a dye useful in embodying the invention include the compounds represented by the following formulas [VI-a], [I-b], [VI-c] and [VI-d].

Formula [VI-a]

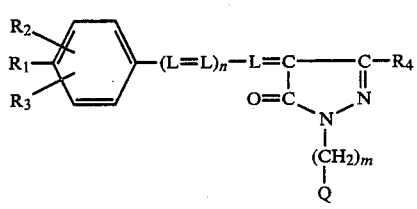

In this formula, $R_1$ is an atomic group represented by

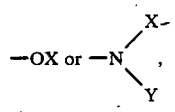

wherein X and Y independently represent a hydrogen atom, alkyl group, cyanoalkyl group, carboxyalkyl group, sulfoalkyl group, hydroxyalkyl group, halogenated alkyl group, or possibly substituted alkyl group (or sodium- or potassium salt thereof). $R_2$ and $R_3$ independently represent a hydrogen atom, halogen atom, alkyl group, hydroxy group, alkoxy group, alkylthio group or a group similar to the previously defined —OX group. Q represents a phenyl group having, as a substituent group, at least one halogen atom, carboxy group, sulfo group, or sulfoalkyl group or sodium-salt or potassium salt thereof); sulfoalkyl gorup, sulfoalkoxyalkyl group or sulfoalkylthioalkyl group. L represents a methine group possibly having a substituent group. $R_4$ represents an alkyl group, carboxy group, alkyloxycarbonyl group; or unsubstituted amino group, or acyl-substituted amino group. m is an integer 1 or 2; and n is 0 or 1.

Formula [VI-b]

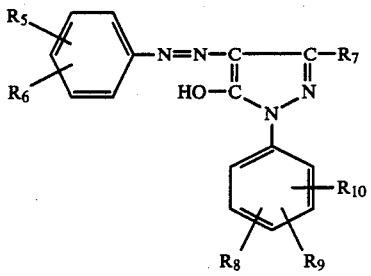

In this formula, $R_5$, $R_6$, $R_8$, $R_9$ and $R_{10}$ independently represent a hydrogen atom, halogen atom, alkyl group, hydroxyl group, alkoxy group, amino group, acylamino group, carboxyl group; or sulfon group (or sodium-salt and potassium-salt thereof). $R_7$ represents an alkyl group, or carboxyl group.

Formula [VI-c]

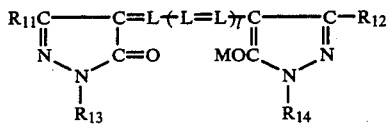

In this formula, $R_{11}$ and $R_{12}$ independently represent an alkyl group, substituted alkyl group, aryl group, alkoxycarbonyl group, or carboxyl group. $R_{13}$ and $R_{14}$ independently represent a sulfonic-substituted or carboxyl-substituted alkyl or sulfonic group; carboxyl-substitued or sulfonic-substituted aryl group or sodium-salt or potassium salt thereof. L represents a substituted or unsubstituted methine chain. M represents a sodium, potassium or hydrogen atom. l is 0 or 1.

Formula [VI-d]

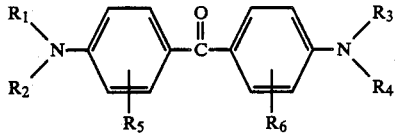

In this formula, $R_1$, $R_2$, $R_3$ and $R_4$ independently represent any of an alkyl group, hydroxyalkyl group, cyano group, alkylcyano group, alkoxy group, and sulfoalkyl group. $R_5$ and $R_6$ independently represent a sulfonic group, or alkylsulfonic group.

The typical examples of compounds expressed by formula [VI-a] through [VI-d] are as follows.

TABLE 1

Formula [VI-a]

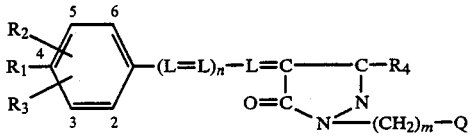

| | $R_1$ | $R_2$ | $R_3$ | $R_4$ | Q | n | m |
|---|---|---|---|---|---|---|---|
| a-1 | $H_3C$, $NaSO_3CH_2CH_2$ N— | 5-H | 3-H | $-CH_3$ | 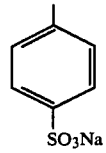 | 1 | 0 |
| a-2 | $CH_3CH_2$, $NaSO_3CH_2CH_2$ N— | 5-H | 2-$CH_3$ | $-C_2H_5$ | 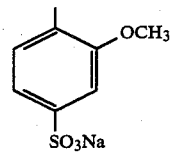 | 0 | 0 |
| a-3 | $CH_3$, $NaSO_3CH_2CH_2$ N— | 5-H | 3-H | $-NHCONHCH_3$ | 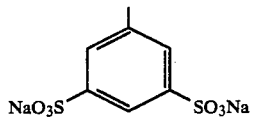 | 0 | 0 |
| a-4 | $H_3C-CH_2-SO_2-CH_2-CH_2$, $H_3C-CH_2-SO_2-CH_2-CH_2$ N— | 5-H | 3-H | $-COOH$ | 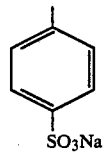 | 0 | 0 |

TABLE 1-continued
Formula [VI-a]
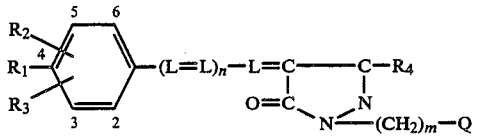
| | $R_1$ | $R_2$ | $R_3$ | $R_4$ | Q | n | m |
|---|---|---|---|---|---|---|---|
| a-5 | $(Cl-CH_2CH_2)_2N-$ | 5-H | 3-H | $-COOH$ | 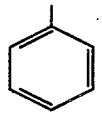 | 0 | 0 |
| a-6 | $(H_3C)_2N-$ | 5-H | 3-H | $CH_3$ | $CH_2SO_3Na$ | 0 | 2 |
| a-7 | $(H_3C-CH_2)(Cl-CH_2CH_2)N-$ | 5-H | 3-H | $-COOH$ | $CH(OH)CH_2SO_3Na$ | 0 | 1 |
| a-8 | $(H_3C)_2N-$ | 5-H | 3-H | $-NHCONHCH_3$ | $CH_2CH_2SO_3Na$ | 0 | 2 |
| a-9 | $(NCCH_2CH_2)_2N-$ | 5-H | 3-H | $-NHSO_2CH_3$ | $CH_2SO_3Na$ | 0 | 2 |
| a-10 | $(CH_3)(HOCH_2CH_2)N-$ | 5-H | 3-H | $-CH_3$ | 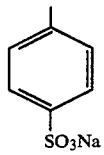 | 0 | 0 |
| a-11 | $(H_3C)_2N-$ | 5-H | 3-H | $-CH_3$ | 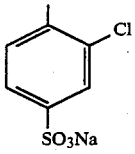 | 0 | 0 |
| a-12 | $(H_3C)_2N-$ | 5-H | 3-H | $-NH_2$ | 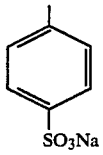 | 0 | 0 |
| a-13 | $(H_3C)_2N-$ | 5-H | 3-H | $-COOC_2H_5$ | 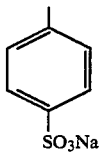 | 0 | 0 |

TABLE 1-continued

Formula [VI-a]

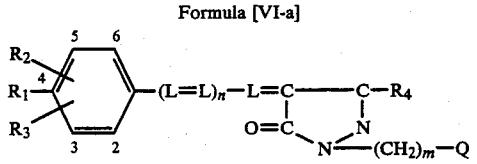

| | $R_1$ | $R_2$ | $R_3$ | $R_4$ | Q | n | m |
|---|---|---|---|---|---|---|---|
| a-14 | $H_3C$, $H_3C$ N— | 5-H | 3-H | —$CH_3$ | 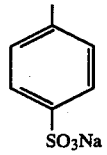 | 0 | 0 |
| a-15 | NC—$CH_2CH_2$, NC—$CH_2CH_2$ N— | 5-H | 2-$OCH_3$ | —COOH | 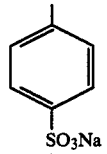 | 0 | 0 |
| a-16 | $NaO_3S$—$CH_2CH_2$, $NaO_3S$—$CH_2CH_2$ N— | 5-H | 3-H | —COOH | 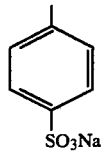 | 0 | 0 |
| a-17 | $CH_3$, $NaSO_3CH_2CH_2$ N— | 5-H | 3-H | —NHCCH$_3$ ‖ O | 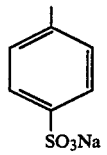 | 0 | 1 |
| a-18 | $NaO_3SCH_2CH_2CH_2O$— | 5-H | 3-H | —$CH_3$ | $CH_2SO_3Na$ | 0 | 2 |
| a-19 | $CH_3$, $CH_3$ N— | 5-H | 3-H | —COOH | 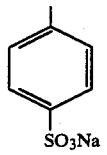 | 1 | 0 |

TABLE 2

Formula [VI-b]

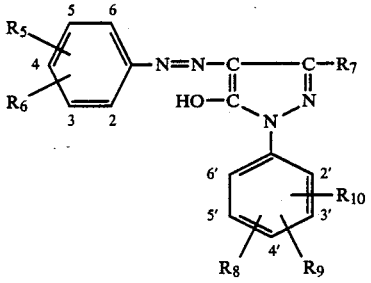

| | $R_5$ | $R_6$ | $R_7$ | $R_8$ | $R_9$ | $R_{10}$ |
|---|---|---|---|---|---|---|
| b-1 | $NaO_3S$-4 | H | —COOH | 5'-H | 4'-$SO_3Na$ | 2'-H |
| b-2 | $NaO_3S$-4 | H | —$CH_3$ | 5'-Cl | 4'-$SO_3Na$ | 2'-Cl |

TABLE 2-continued

Formula [VI-b]

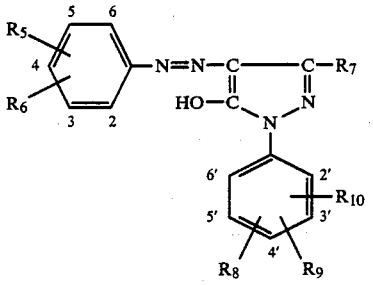

| | $R_5$ | $R_6$ | $R_7$ | $R_8$ | $R_9$ | $R_{10}$ |
|---|---|---|---|---|---|---|
| b-3 | HOOC-3 | HOOC-5 | —$CH_3$ | 5'-H | 3'-$SO_3Na$ | 2'-H |

TABLE 3
Formula [VI-c]
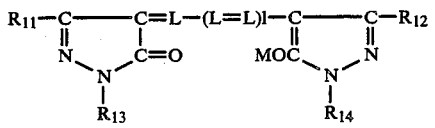
| | $R_{11}$ | $R_{12}$ | $R_{13}$ | $R_{14}$ | L—(L=L)l | M |
|---|---|---|---|---|---|---|
| c-1 | $CH_3$— | —$CH_3$ | 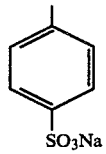 | 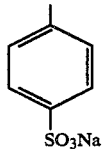 | CH—CH=CH— | Na |
| c-2 | $CH_3$ | —$CH_3$ | 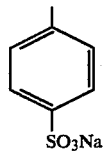 | 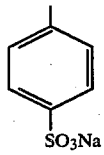 | CH—CH=CH— | Na |
| c-3 | HOOC— | —COOH | 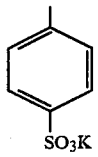 | 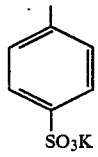 | CH—CH=CH— | K |
| c-4 | $CH_3$— | —$CH_3$ | $CH_2CH_2CH_2SO_3Na$ | $CH_2CH_2CH_2SO_3Na$ | CH— | Na |
| c-5 | $CH_3CH_2$— | —$CH_2CH_3$ | $CH_2CH_2CH_2COONa$ | 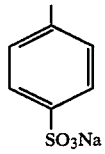 | CH— | Na |
| c-6 | $CH_3$— | —$CH_3$ | 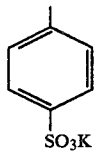 | 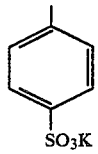 | CH— | K |
| c-7 | NaOOC— | —COONa | 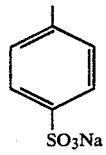 | 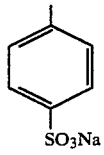 | CH— | Na |
TABLE 4
Formula [VI-d]
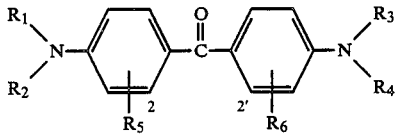
| | $R_1$ | $R_2$ | $R_3$ | $R_4$ | $R_5$ | $R_6$ |
|---|---|---|---|---|---|---|
| d-1 | $CH_3$— | $CH_3$— | $CH_3$ | $CH_3$ | 2-$SO_3Na$ | 2'-$SO_3Na$ |
| d-2 | $HOCH_2$— | $HOCH_2$ | $CH_2OH$ | $CH_2OH$ | 2-$SO_3Na$ | 2'-$SO_3Na$ |

TABLE 4-continued

Formula [VI-d]

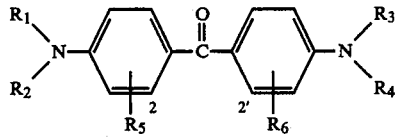

| | $R_1$ | $R_2$ | $R_3$ | $R_4$ | $R_5$ | $R_6$ |
|---|---|---|---|---|---|---|
| d-3 | $CH_3OCH_2CH_2$ | $CH_3OCH_2CH_2$ | $CH_2CH_2OCH_3$ | $CH_2CH_2OCH_3$ | 2-$SO_3Na$ | 2'-$SO_3Na$ |
| d-4 | $CNCH_2CH_2$ | $CNCH_2CH_2$ | $CH_2CH_2CN$ | $CH_2CH_2CN$ | 2-$SO_3Na$ | 2'-$SO_3Na$ |
| d-5 | $HOCH_2CH_2$ | $HOCH_2CH_2$ | $CH_2CH_2OH$ | $CH_2CH_2OH$ | 2-$CH_2SO_3Na$ | 2'-$CH_2SO_3Na$ |
| d-6 | $HOCH_2CH_2OCH_2CH_2$ | $HOCH_2CH_2OCH_2CH_2$ | $CH_2CH_2OCH_2CH_2OH$ | $CH_2CH_2OCH_2CH_2OH$ | 2-$SO_3Na$ | 2'-$SO_3Na$ |

The examples of a sensitizer incorporated into a silver halide emulsion of the invention include active gelatin; sulfur sensitizers such as sodium thiosulfate, allyl thiocarbamide, thiourea, and allyl isothiocyanate; selenium sensitizers such as N,N-dimethylseleno emulsion, and selenourea; reduction sensitizers such as triethylenetetramine, and stannous chlroride; and various noble metal sensitizers such as potassium chloroaurite, potassium aurithiocyanate, potassium chloroaurate, 2-aurosulfobenzothiazolemethyl chloride, ammonium chloropalladate, potassium chloroplatinate, and sodium chloropaladite or the like are available. Such sensitizers can be used singly or in combination of more than two. When using a gold sensitizer, ammonium thiocyanate can be used as an assistant. Of these sensitizers, a sulfur sensitizer is the most advantageous. The sulfur sensitizer is preferably used at a rate of 15 to 150 mg per mol silver halide.

Favorable effects are attainable when a silver halide emulsion layer according to the invention contains a tetrazolium compound such as disclosed, for example, in Japanese Patent O.P.I. Publication Nos. 18317/1977, 17719/1978, 17720/1978 and 149946/1986. Those compounds are, for example, tetrazolium compounds expressed by the following general formulas [VII-1], [VII-2], and [VII-3].

[VII-1]

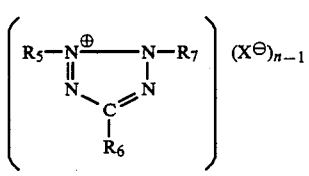

[VII-2]

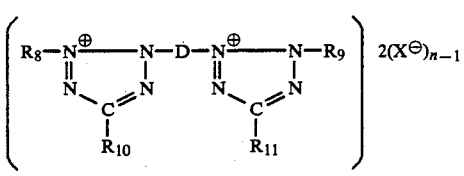

[VII-3]

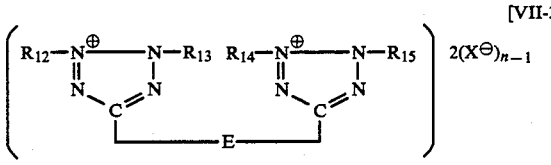

In these formulas, $R_5$, $R_7$, $R_8$, $R_9$, $R_{12}$, $R_{13}$, $R_{14}$, and $R_{15}$ independently represent any group selected from an alkyl group (such as methyl group, ethyl group, propyl group, and dodecyl group), allyl group, phenyl group (such as phenyl group, tolyl group, hydroxyphenyl group, carboxyphenyl group, aminophenyl group, mercaptophenyl group, and methoxyphenyl group), naphthyl group (such as α-naphthyl group, β-naphthyl group, hydroxynaphthyl group, carboxynaphthyl group, and aminonaphthyl group), and heterocyclic group (such as thiazolyl group, benzothiazolyl group, oxazolyl gropu, pyrimidinyl group, and pyridyl group). Each of these groups may be a group capable of forming a metal chelate or complex. $R_6$ through $R_{10}$, and $R_{11}$ independently represent any group selected from an allyl group, phenyl group, naphthyl group, heterocyclic group, alkyl group (such as methyl group, ethyl group, propyl group, butyl group, mercaptomethyl group, and mercaptoethyl group), hydroxyl group, alkylphenyl group, alkoxyphenyl group, carboxyl gropu (salt thereof), carboxyalkyl group (such as methoxycarbonyl group, and ethoxycarbonyl group), amino group (such as amino group, ethylamino group, and anilino group), mercapto group, nitro group, and hydrogen atom. D represents a bivalent aromatic group; and E represents any group selected from an alkylene group, allylene group, and aralkylene group. $X^{\ominus}$ represents an anion; and n is 1 or 2. However, when the compound has an inner salt, n is 1.

The typical examples of a cationic portion in a tetrazolium compound useful in the present invention are as follows. However, the examples of a cationic portion in a compound useful in the invention are not limited only to these examples.

(T-1) 2-(benzothiazole-2-yl)-3-phenyl-5-dodecyl-2H-tetrazolium
(T-2) 2,3-diphenyl-5-(4-t-octyloxyphenyl)-2H-tetrazolium
(T-3) 2,3,5-triphenyl-2H-tetrazolium
(T-4) 2,3,5-tri(p-carboxyethylphenyl)-2H-tetrazolium
(T-5) 2-(benzothiazole-2-yl)-3-phenyl-5-(o-chlorophenyl)-2H-tetrazolium
(T-6) 2,3-diphenyl-2H-tetrazolium
(T-7) 2,3-diphenyl-5-methyl-2H-tetrazolium
(T-8) 3-(p-hydroxyphenyl)-5-methyl-2-phenyl-2H-tetrazolium
(T-9) 2,3-diphenyl-5-ethyl-2H-tetrazolium
(T-10) 2,3-diphenyl-5-n-hexyl-2H-tetrazolium
(T-11) 5-cyano-2,3-diphenyl-2H-tetrazolium
(T-12) 2-(benzothiazole-2-yl)-5-phenyl-3-(4-tolyl)-2H-tetrazolium
(T-13) 2-(benzothiazole-2-yl)-5-(4-chlorophenyl)-3-(4-nitrophenyl)-2H-tetrazolium
(T-14) 5-ethoxycarbonyl-2,3-di(3-nitrophenyl)-2H-tetrazolium
(T-15) 5-acetyl-2,3-di(p-ethoxyphenyl)-2H-tetrazolium
(T-16) 2,5-diphenyl-3-(p-tolyl)-2H-tetrazolium (T-17) 2,5-diphenyl-3-(p-iodophenyl)-2H-tetrazolium
(T-18) 2,3-diphenyl-5-(p-diphenyl)-2H-tetrazolium
(T-19) 5-(p-bromophenyl)-2-phenyl-3-(2,4,6-trichlorophenyl)-2H-tetrazolium
(T-20) 3-(p-hydroxyphenyl)-5-(p-nitrophenyl)-2-phenyl-2H-tetrazolium
(T-21) 5-(3,4-dimethoxyphenyl)-3-(2-ethoxyphenyl)-2-(4-methoxyphenyl)-2H-tetrazolium
(T-22) 5-(4-cyanophenyl)-2,3-diphenyl-2H-tetrazolium
(T-23) 3-(p-acetamidophenyl)-2,5-diphenyl-2H-tetrazolium
(T-24) 5-acetyl-2,3-diphenyl-2H-tetrazolium
(T-25) 5-(flu-2yl)-2,3-diphenyl-2H-tetrazolium
(T-26) 5-(thien-2yl)-2,3-diphenyl-2H-tetrazolium
(T-27) 2,3-diphenyl-5-(pyrido-4yl)-2H-tetrazolium
(T-28) 2,3-diphenyl-5-(quinole-2yl)-2H-tetrazolium
(T-29) 2,3-diphenyl-5-(benzoxazole-2yl)-2H-tetrazolium
(T-30) 2,3-diphenyl-5-nitro-2H-tetrazolium
(T-31) 2,2',3,3'-tetraphenyl-5,5'-1,4-butylene-di-(2H-tetrazolium)
(T-32) 2,2',3,3'-tetraphenyl-5,5'-p-phenylene-di-(2H-tetrazolium)
(T-33) 2-(4,5-dimethylthiazole-2yl)-3,5-diphenyl-2H-tetrazolium
(T-34) 3,5-diphenyl-2-(triazine-2yl-2H-tetrazolium)
(T-35) 2-(benzothiazole-2yl)-3-(4-methoxyphenyl)-5-phenyl-2H-tetrazolium
(T-36) 2,3-dimethoxyphenyl-5-phenyl-2H-tetrazolium
(T-37) 2,3,5-tris(methoxyphenyl)-2H-tetrazolium
(T-38) 2,3-dimethylphenyl-5-phenyl-2H-tetrazolium
(T-39) 2,3-hydroxyethyl-5-phenyl-2H-tetrazolium
(T-40) 2,3-hydroxymethyl-5-phenyl-2H-tetrazolium
(T-41) 2,3-cyanohydroxyphenyl-5-phenyl-2H-tetrazolium
(T-42) 2,3-di(p-chlorophenyl)-5-phenyl-2H-tetrazolium
(T-43) 2,3-di(hydroxyethoxyphenyl)-5-phenyl-2H-tetrazolium
(T-44) 2,3-di(2-pyridyl)-5-phenyl-2H-tetrazolium
(T-45) 2,3,5-tris(2-pyridyl)-2H-tetrazolium
(T-46) 2,3,5-tris(4-pyridyl)-2H-tetrazolium When a tetrazolium compound is used as an undiffusive compound, an undiffusive tetrazolium compound obtained by selecting its relevant cationic and anioic portions is useful.

The examples of an anioic portion on a tetrazolium compound of the invention are as follows;

halogen ions such as chloride ions, bromide ions, such iodide ions;

acid radicals of inorganic acids such as sulfuric acid, nitric acid, and perchloric acid;

acid radicals of organic acids such as sulfonic acid, and carboxylic acid;

lower alkyl benzenesulfonic anions such as p-toluenesulfonic anions;

higher alkylbenzenesulfonic anions such as p-dodecylbenzenesulfonic anions;

higher alkylsulfate ester anions such as lauryl sulfate anions;

dialkyl sulfosuccinate anions such as di-2-ethylhexyl sulfosuccinate anions;

polyether alcohol-sulfate ester anions such as cetyl polyethenoxysulfate anions;

higher fatty acid anions such as stearic anions;

anions comprising polymers, such as polyacrylic anions, and having acid radicals integrated.

Further, an undiffusive tetrazolium compound according to the invention can be synthesized by deliberately selecting its cationic and anioic portions. The so-synthesized compounds of the invention are those typified by a 2,3,5,-triphenyl-2H-tetrazolium-dioctyl succinate sulfonate salt. As detailed later in Example, these compounds are prepared in such a manner as: the respective soluble salts of the anionic and cationic portions are independently dispersed into gelatin, whereby the resultant gelatin solutions are blended together and dispersed in a gelatin matrix; or the similar compounds are prepared by first preparing pure crystals of oxidants, then they are dissolved in appropriate solvents such as dimethyl sulfoxide, thereby each resultant solution is dispersed in a gelatin matrix. When the dispersion is not readily homogeneous, use of an appropriate homogenizer such as a supersonic homogenizer wave and Manton-Gohline homogenizer for emulsification and dispersion attains a favorable result. Further, the compounds can be first slightly dispersed in a high boiling solvent such as dioctylphthalate to prepare a protected emulsion, thereby the resultant emulsion is dispersed in a hydrophilic colloidal layer. It is a preferred mode of embodying the invention that a silver halide emulsion layer of the invention incorporates a hydrazine compound instead of the above tetrazolium compound.

The hydrazine compounds advantageous in embodying the invention include those represented by the following general formulas [VIII] and [IX].

$R_1NHNHCHO$ Formula [VIII]

$R_1NHNHCOR_2$ Formula [IX]

In these formulas, $R_1$ and $R_2$ independently represent a pyridyl group, quinoline group, furan group, or thiophene group, wherein each group may have a substituent such as an aryl group, alkyl group, substituted ureide group, aliphatic amino group, halogen atom, alkoxy group, and alkylamino group. $R_1$ and $R_2$ can be an aryl group (such as phenyl group or naphthyl group) that may have a substituent; or an alkyl group that may have a substituent.

The aryl group represented by $R_1$ or $R_2$ may have a benzene ring or naphthalene ring, wherein such a ring may have various substituent, wherein the examples of preferred substituent include a straight-chained or branched alkyl group (preferably a group having 1 to 20 carbon atoms, being typified by a methyl group, ethyl group, isopropyl group, and n-dodecyl group); alkoxy group (preferably a group having 1 to 20 carbon atoms, being typified by a methoxy group, and ethoxy group); aliphatic acylamino group (preferably a group having 2 to 21 carbon atoms and an alkyl group, and being typified by an acetylamino group, and heptylamino group); and aromatic acylamino group; and, additionally, include those to which any of the above substituted or unsubstituetd aromatic ring is bonded via a bonding roup such as —CONH, —S—, —O—, —$SO_2$NH—, —NHCONH—, and —$CH_2$CHN—.

The hydrazine compounds can be synthesized by referring to the description in U.S. Pat. No. 4,269,929.

The hydrazine compound can be incorporated into an emulsion layer; or a hydrophilic colloid layer adjacent to the emulsion layer; or another hydrophilic colloid layer. Preferably, the similar compound is incorporated into the emulsion layer of a layer adjacent to the emulsion layer.

The hydrazine compound can be incorporated into the similar layers by first dissolving in an alcohol such as methanol, and ethanol; glycol such as ethylene glycol, and diethylene glycol; ether; and ketone. The amount of the similar compound added is preferably $10^{-6}$ to $10^{-1}$, in particular, $10^{-4}$ to $10^{-2}$ mol per mol silver halide.
The examples of particularly preferred hydrazine compound are as follows. It should be noted that the scope of the invention is not limited only to these compounds.
H-1
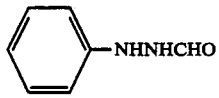
H-2
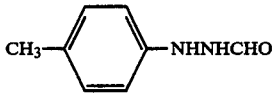
H-3
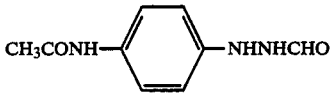
H-4
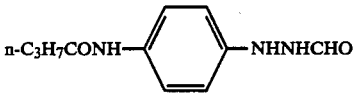
H-5
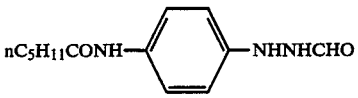
H-6
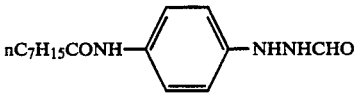
H-7
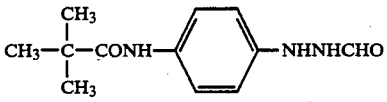
H-8
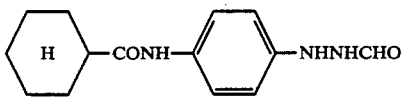
H-9
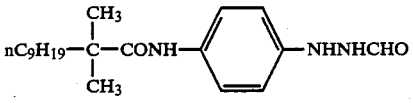
H-10
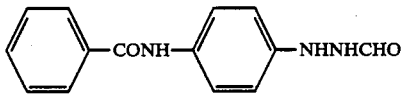
H-11
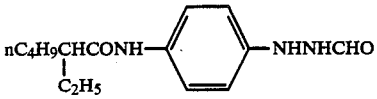
H-12
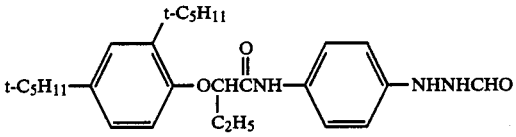

-continued
H-13
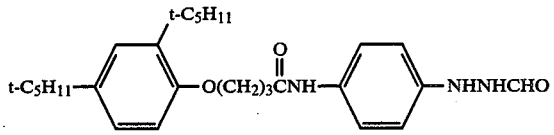
H-14
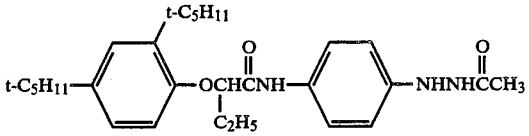
H-15
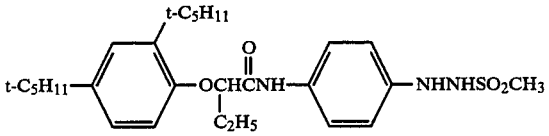
H-16
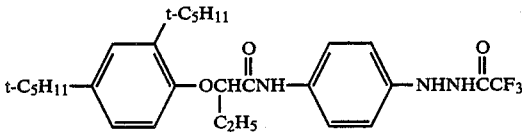
H-17
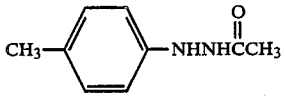
H-18
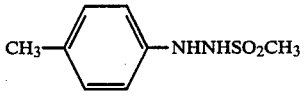
H-19
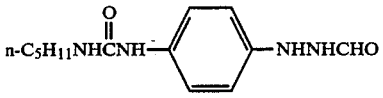
H-20
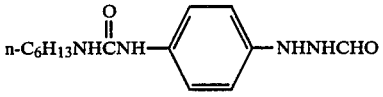
H-21
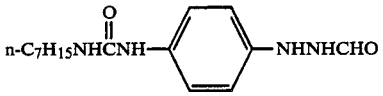
H-22
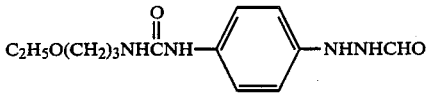
H-23
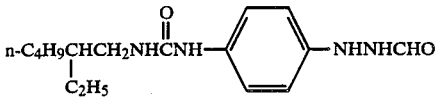
H-24
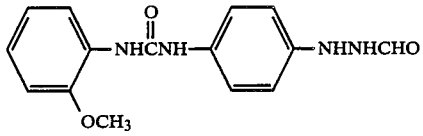

-continued

H-25

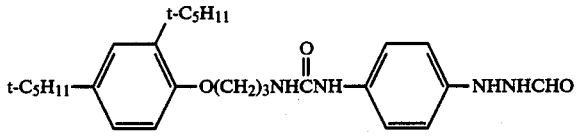

H-26

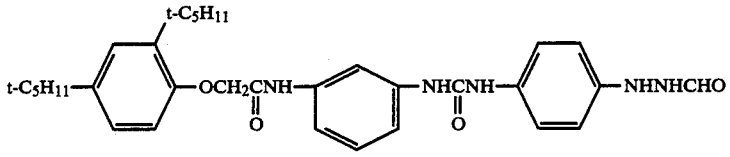

H-27

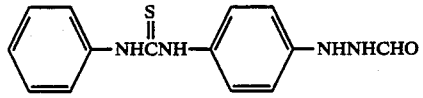

H-28

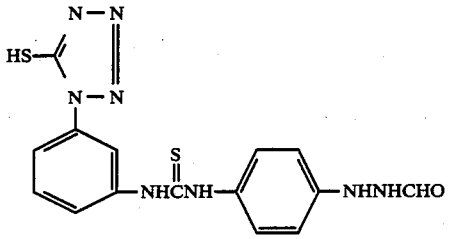

H-29

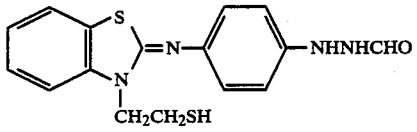

H-30

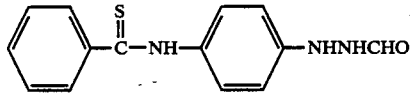

H-31

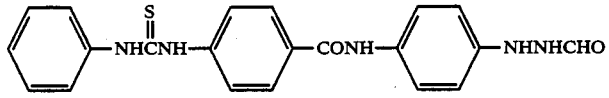

H-32

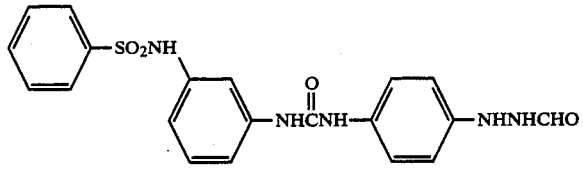

H-33

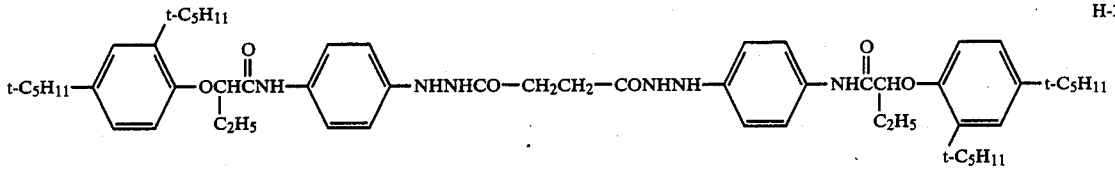

The silver halide emulsions used in embodying the invention may be stabilized by using the compounds described for example in U.S. Pat. Nos. 2,444,607, 2,716,062, and 3,512,982; West German DAS Patent Nos. 1,189,380, 2,058,626, and 2,118,411; Japanese Patent Examined Publication No. 4133/1968; U.S. Pat. No. 3,342,596; Japanese Patent Examined Publication No. 4417/1972; West German DAS Patent No. 2,149,789; Japanese Patent Examined Publication Nos. 2825/1964, 13566/1974, and 40665/1975; Japanese Patent O.P.I. Publication No. 198147/1986. Those particularly preferred among these compounds are 5,6-trimethylene-7-hydroxy-S-triazolo(1,5-a)pyridine, 5,6-trimethylene-7-hydroxy-S-triazolo(1,5-a)pyrimidine, 5-methyl-7-hydroxy-S-triazolo(1,5-a)pyrimidine, 7-hydroxy-S-triazolo(1,5-a)pyrimidine, 5-methyl-6-hydroxy-S-triazolo(1,5-)pyrimidine, gallate esters (such as isoamyl gallate, dodecyl gallate, propyl gallate, and sodium gallate), mercaptans (such as 1-phenyl-5-mercaptotetrazole, and 2-mercaptobenzothiazole), benzotriazoles (such as 5-bromo-benzotriazole, and 5-methylbenzotriazole), benzimidazoles (such as 6-nitrobenzimidazole), and quaternary chloride compounds of disulfides.

The materials and methods known in the art are applied to the hydrophilic colloid, support, and processes of the invention.

The developing agents advantageous used in the invention are those such that described in The Theory of the Photographic Process, 4th edition, by T. H. James, pp. 291–334; and in Journal of the American Chemical Society, Vol. 73, pp. 3100 (1951). These developing agents are used either singly or in combination of more than two. When more than two types combinedly used, more favorably results will be attained. Developer solutions used for developing the light-sensitive material of the invention may contain as a preservative sulfite such as sodium sulfite, and potassium sulfite. Such as preservative does not hinder the effects of the invention, and this fact is one of the advantages of the invention.

[EXAMPLE]

The present invention is hereunder described in detail. It should be understood that the scope of the invention is not limited only to the example.

EXAMPLE 1

Preparation of samples

The [Solution B] specified below was added to the [Solution A] specified below at an adding velocity listed in the following Table 5, in the acid environment of pH 3.0 controlled with nitric acid, while the silver potential EAg being maintained at 170 mV, and both solutions were blended together in compliance with a controlled double-jet process, while the EAg being controlled using one normal NaCl, whereby the [Solution C] was added for 2 minutes at a reaction temperature and adding velocity identical with those of [Solution B], and then, furthre added at a velocity 0.99 times that of the listed velocity while the EAg of [Solution B] being controlled with one normal NaCl. Thus, the silver halide emulsions a, b, c, d, and e according to the invention, listed in Table 5 were obtained.

[Solution A]

Gelatin 5.6 g
10% ethanol solution of polyisopropylene-polyethyleneoxydisuccinate ester sodium salt 0.56 ml
Sodium chloride 0.12 g
Nitric acid (conc.) 0.43 ml
Distilled water 445 ml

[Solution B]

Silver nitrate 60 g
Nitric acid (conc.) 0.208 ml
Distilled water 85.2 ml

[Solution C]

Gelatin 3 g
10% ethanol solution of polyisopropyleneo-polyethyleneoxydisuccinate ester sodium salt 0.3 ml
Potassium bromide 4.2 g
Sodium chloride 18.6 g
Na RhC 1% aqueous solution 0.02 ml
Distilled water 87.3 ml

[Solution D]

Gelatin 1.4 g
10% ethanol solution of polyisopropylene-polyethyleneoxydisuccinate ester sodium salt 0.14 ml
Distilled water 48.8 ml

TABLE 5

| | | (Adding velocity ml/min.) | | | | |
|---|---|---|---|---|---|---|
| Emulsion No. | | a | b | c | d | e |
| Reaction temp. | | 30° C. | 34° C. | 40° C. | 40° C. | 50° C. |
| Adding time for Solution B | 0 min. | 11.74 | 11.74 | 17.07 | 1.06 | 1.06 |
| | 2 min. | 11.74 | 11.74 | 17.07 | 1.06 | 1.06 |
| | 3 min. | 11.93 | 11.93 | 17.36 | 1.08 | 1.08 |
| | 4 min. | 12.14 | 12.14 | 17.66 | 1.10 | 1.10 |
| | 5 min. | 12.34 | 12.34 | 17.95 | 1.11 | 1.11 |
| | 6 min. | 12.55 | 12.55 | 18.25 | 1.13 | 1.13 |
| | 7 min. | 12.75 | 12.75 | 18.55 | 1.15 | 1.15 |
| | 8 min. | 12.96 | 12.96 | 18.86 | 1.17 | 1.17 |
| | 9 min. | | | 19.16 | 1.19 | 1.19 |
| | 10 min. | | | 19.47 | 1.21 | 1.21 |
| | 11 min. | | | 19.47 | 1.23 | 1.23 |
| | 14 min. | | | | 1.29 | 1.29 |
| | 18 min. | | | | 1.37 | 1.37 |
| | 22 min. | | | | 1.45 | 1.45 |
| | 26 min. | | | | 1.54 | 1.54 |
| | 30 min. | | | | 1.62 | 1.62 |
| | 35 min. | | | | 1.74 | 1.74 |
| | 40 min. | | | | 1.85 | 1.85 |
| | 45 min. | | | | 1.98 | 1.98 |
| | 50 min. | | | | 2.10 | 2.10 |
| | 55 min. | | | | 2.23 | 2.23 |
| | 60 min. | | | | 2.36 | 2.36 |
| Ave. size of silver halide grains obtained | | 0.06 μm | 0.075 μm | 0.095 μm | 0.20 μm | 0.30 μm |

The average grains sizes of the respective obtained silver halide emulsions are listed in Table 5. Additionally, a silver chloride content of silver halide grains in the respective emulsion was 90 mol %; a rhodium content was $2\times10^{-6}$ mol per mol silver halide; and monodispersity ranged from 8 to 15%.

In measuring the EAg level, a metal silver electrode as well as a double-junction type saturated Ag/AgCl reference electrode were used (the constitution of the latter electrode used was a double junction type disclosed in Japanese Patent O.P.I. Publication No. 197534/1982).

In addtion [Solution B] and [Solution C], a variable flow rate, roller tube quantity determination pump was used.

Additionally, in the course of addition it was confirmed by observing a sampled emulsion using an electron microscope that no further grains were generated, and that an addition rate was not exceeding the critical growth rate in an emulsion system.

To emulsions a through thus prepared, was respectively added 6-methyl-4-hydroxy-1,3,3a,7-tetraazaindene at a rate of 200 mg per mol silver halide, thereby the pH level of each emulsion was adjusted to 5.7 using sodium carbonate, and then, to the respective emulsions was added [Solution D]. Next, each silver halide emulsion was subjected to washing and desalination according to a conventional method, thereby to each emulsion was added 58 mg of 6-methyl-4-hydroxy-1,3,3a,7tetraazaindene and 150 mg of potassium bromide per mol silver halide, and each emulsion was subjected to sulfur sensitization. Once the sulfur sensitization was complete, 570 mg of 6-methyl-4-hydroxy-1,3,3a,7-tetraazaindene as a stabilizer and 25 g of gelatin per mol silver halide were added, thereby the following additives were further added, and, thus each coating solution for emulsion layer was prepared. Each coating solution was applied to and dried on a 100 μm thick polyethylene terephthalate film which has been subjected to latex subbing and provided with a lamination comprising the backing layer and backing-protecting layer specified below. Thus sample Nos. 1 through 21 listed in Table 6 were obtained. The coating silver weight of the respective samples was commonly 3.5 g/m².

[Additives for coating solutions of emulsion layers]

Saponin 100 mg/m²
Potassium bromide 3 mg/m²
Desensitizing dye (example compound (11), (17), or (26)) specified in Table 6
Sodium hydroxide 10 mg/m²
Tetrazolium compound (example compound T-38) specified in Table 6
Hydrazine compound (example compound II-26) specified in Table 6
Sodium dodecylbenzenesulfonate 21 mg/m²
Butyl acrylate-styrene-acrylic acid copolymer 1 g/m²
5-methylbenzotriazole 10 mg/m²
5-phenyl-1-mercaptotetrazole 11.5 mg/m²
2-mercaptobenzimdazole-5-sulfonic acid 1 mg/m²
Benzyl-triphenylphosphonium chloride 5 mg/m²
Following compound (Z) 5 8 mg/m²

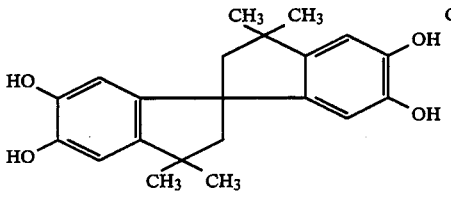

Compound (Z)

(Emulsion composition for protection layer)

Gelatin 1 14 g/m²
Following compound (M) 32.7 mg/m²
Amorphous silica 20 mg/m²
Following compound (S) 0.5 mg/m²
Citric acid 5.4 mg/m²
Formaldehyde 71.5 mg/m²
Following compound (K) 100 mg/m²

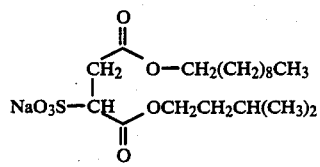

Compound (M)

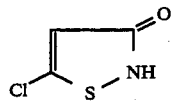

Compound (S)

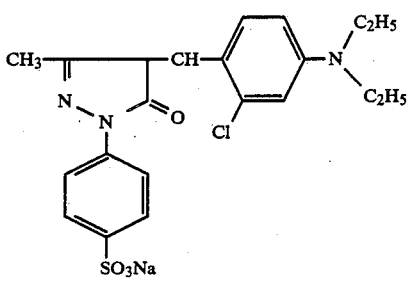

Compound (K)

[Backing layer]

Latex polymer: butyl acrylate-styrene copolymer 0.5 g/m²
Saponin 200 mg/m²
Backing dye

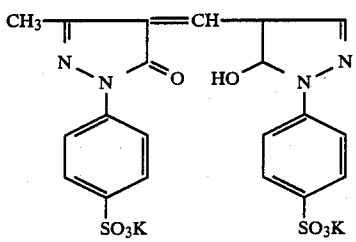

(a)
Amount listed in Table 6

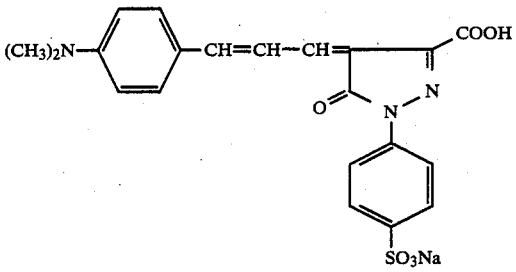

(b)
Amount listed in Table 6

Osein gelatin 2.0 g/m²

[Backing-protecting layer]

Dioctylsulfosuccinate ester 300 mg/m²
Matting agent: methyl methacrylate (average grain size, 4.0 μm) 100 mg/m²
Osein gelatin (isoelectric point, 4.9) 1.1 g/m²
Fluorinated sodium dodecylbenzenesulfonate 50 mg/m²

[Sensitivity evaluation]

The samples thus obtained were exposed, through an optical wedge, with an "illuminated room" printer that has a light source having spectra shown in FIG. 1 and comprising an electrodeless discharge tube manufactured by Fusion Co. in U.S., thereby the samples were developed using the following developer and fixer solutions. The sensitivity is represented by a value relative to an inverse number of an exposure that is required for attaining density of 3.0, wherein the sensitivity of sample No. 2 was assumed to be 100.

Table 6 lists the results.

[Evaluation of safelight insensitivity]

(1) Fog: each sample was irradiated at approx. 300 luxes for 60 minutes with an anti-fading fluorescent lamp (Toshiba Corporation, FL40SW-NU) wrapped with a UV filtering tube (Mitsubishi Plastics Industries, Ltd.), thereby the sample was subjected to the developing in a manner identical with that of sensitivity evaluation, in order to evaluate fogging. Incidentally, irradiation with the safelight was performed independently on the Em face and BC face. Table 6 lists the results.

(2) Dot % change: a color transparency having 50% dot percentage was tightly placed on each sample, thereby each sample was exposed using an "illuminated room" printer used in sensitivity evaluation, and then, irradiated at approx. 300 luxes for 30 minutes with a safelight used in safelight fogging evaluation, and developed in a manner identical with that of sensitivity evaluation. The exposure was controlled so that the 50% dot percentage was obtained by developing immediately after exposing with the illuminated room printer, whereby the change in dot percentage due to irradiation with the safelight was measured. Incidentally, irradiation with the safelight was performed independently on the Em face and BC face. Table 6 lists the ersults.

[Developer solution compositions]

(Composition A)

Pure water (Deionized water) 150 ml
Disodium ethylenediaminetetraacetate 2 g
Diethylene glycol 50 g
Potassium sulfite (55% W/V aqueous solution) 100 ml
Potassium carbonate 50 g
Hydroquinone 15 g
5-methylbenzotriazole 200 mg
1-phenyl-5-mercaptotetrazole 30 mg
Potassium hydroxide amount for for adjusting pH of the solution to 10.4(11.6 for Samples containing hidrazine)
Potassium bromide 4.5 g (Composition B)

Pure water (Deionized water) 3 ml
Diethylene glycol 50 g
1-phenyl-3-pyrazolidone 500 mg
Disodium ethylenediaminetetraacetate 25 mg
Acetic acid (90% aqueous solution) 0.3 ml
5-nitroindazole 110 mg
Before the use of a developer solution, the above composition A and composition B were sequentially dissolved in 500 ml of water, and the solution was adjusted to one liter.

(Fixer compositions)

(Composition A)

Ammonium thiosulfate (72.5% W/V aqueous solution) 240 ml
Sodium sulfite 17 g
Sodium acetate (trihydrate) 6.5 g
Boric acid 6 g
Sodium citrate dihydrate 2 g
Acetic acid (90% W/V aqueous solution) 13.6 ml (Composition B)

Pure water (deionized water) 17 ml
Sulfuric acid (50% W/V aqueous solution) 4.7 g
Aluminum sulfate (8.1% W/V aqueous solution on an $Al_2O_3$ basis) 26.5 g Before the use of a fixer solution, the above composition A and composition B were sequentially dissolved in 500 ml of water, and the solution was adjusted to one liter. The pH level of this fixer was approx. 4.3.

[Developing conditions]

| (Process) | (Temperature) | (Time) |
|---|---|---|
| Developing | 38° C. | 20 sec. |
| Fixing | 23° C. | 20 sec. |
| Washing | normal temp. | 20 sec. |

TABLE 6

| Sample No. | Average grain size (μm) | Desensitizing dye Type | Desensitizing dye Amount added (mg/molAg) | Desensitizing dye Maximum sensitization wave length (λmax) | BC dyes (a) (b) Amount added (mg/m²) (a)/(b) | BC dyes (a) (b) Absorptivity (at λmax) | BC dyes (a) (b) Absorptivity ratio λmax/450 nm | Amount of tetrazdium compound added (g/molAg) | Amount of hydrazine compound added (g/molAg) |
|---|---|---|---|---|---|---|---|---|---|
| 1 | 0.075 | 11 | 20 | 550 | 100/0 | 0.15 | 0.16 | — | — |
| 2 | " | " | " | " | 200/0 | 0.3 | 0.16 | — | — |
| 3 | " | " | " | " | 100/55 | 0.3 | 0.32 | — | — |
| 4 | " | " | " | " | 200/70 | 0.5 | 0.27 | — | — |
| 5 | " | " | " | " | 200/180 | 0.8 | 0.42 | — | — |
| 6 | " | " | " | " | 200/70 | 0.5 | 0.27 | 1.6 | — |
| 7 | " | " | " | " | " | " | " | — | 0.4 |
| 8 | " | 17 | " | 510 | 100/0 | 0.15 | 0.16 | — | — |
| 9 | " | " | " | " | 200/0 | 0.3 | 0.16 | — | — |
| 10 | " | " | " | " | 200/70 | 0.5 | 0.27 | — | — |
| 11 | " | " | " | " | " | " | " | 1.6 | — |
| 12 | " | " | " | " | " | " | " | — | 0.4 |
| 13 | " | 26 | " | 430 | 30/0 | 0.15 | 0.7 | — | — |
| 14 | " | " | " | " | 60/0 | 0.3 | " | — | — |
| 15 | " | " | " | " | 100/0 | 0.5 | " | — | — |
| 16 | " | " | " | " | " | " | " | 1.6 | — |
| 17 | " | " | " | " | " | " | " | — | 0.4 |

TABLE 6-continued

| | | | | | | | | | |
|---|---|---|---|---|---|---|---|---|---|
| 18 | 0.06 | 11 | " | 550 | 200/70 | 0.5 | 0.27 | — | — |
| 19 | 0.095 | " | " | " | " | " | " | — | — |
| 20 | 0.20 | " | " | " | " | " | " | — | — |
| 21 | 0.30 | " | " | " | " | " | " | — | — |

| | Safelight insensitivity | | | | |
|---|---|---|---|---|---|
| | Emulsion layer face | | BC layer face | | |
| Sensitivity | Fog | Dot % change | Fog | Dot % change | |
| 120 | 0.10 | +3% | 0.08 | −20% | Comparative |
| 100 | 0.10 | +3% | 0.06 | −20% | Comparative |
| 100 | 0.10 | +3% | 0.08 | −7% | Invention |
| 100 | 0.10 | +3% | 0.06 | −5% | Invention |
| 100 | 0.10 | +3% | 0.06 | −4% | Invention |
| 103 | 0.08 | ±1% | 0.04 | −5% | Invention |
| 120 | 0.09 | +2% | 0.05 | −5% | Invention |
| 100 | 0.12 | +4% | 0.10 | −18% | Comparative |
| 100 | 0.12 | +4% | 0.08 | −18% | Comparative |
| 100 | 0.12 | +4% | 0.08 | −4% | Invention |
| 105 | 0.09 | +1% | 0.06 | −4% | Invention |
| 120 | 0.10 | +2% | 0.07 | −4% | Invention |
| 70 | 0.08 | +2% | 0.08 | −10% | Comparative |
| 70 | 0.08 | +2% | 0.07 | −6% | Invention |
| 70 | 0.08 | +2% | 0.06 | −4% | Invention |
| 70 | 0.06 | ±0 | 0.04 | −4% | Invention |
| 85 | 0.07 | +1% | 0.05 | −4% | Invention |
| 80 | 0.07 | +3% | 0.03 | −4% | Invention |
| 110 | 0.10 | +2% | 0.06 | −6% | Invention |
| 103 | 0.11 | +3% | 0.05 | −4% | Invention |
| 105 | 0.10 | +3% | 0.06 | −5% | Invention |

As can be understood from the results in Table 6, every comparative example exhibits significant loss in dot percentage relative to the safelight insensitivity on the BC face. In contrast, each sample according to the invention exhibits smaller change in dot percentage relative to the safelight illuminating both the emulsion face and the BC face. In particular, samples incorporating a tetrazolium compound or hydrazine compound demonstrate further improved safelight insensitivity on the emulsion face. Additionally, in terms of difference in average grain size, it is apparent that according to the present invention, both grains having the average grain size of 0.2$\mu$, which are used in the usual photosensitive material for photo-lithography, and those having the average grain size of less than 0.1$\mu$, which is called as "Lippmann emulsion" have the technical advantage of the present invention.

What is claimed is:

1. A silver halide light-sensitive photographic material comprising:

a support;

a silver halide emulsion layer provided on one side of said support, said emulsion layer comprising a desensitizing dye and silver halide grains containing at least 50 mol % silver chloride and rhodium salt in an amount of $10^{-8}$ to $10^{-4}$ mol per mol of silver halide; and a backing layer provided on the other side of said support, said backing layer containing a dye, wherein an absorbancy of said support itself plus said backing layer containing said dye in the maximum spectral absorption wavelength of the desensitizing dye incorporated into said emulsion layer is not less than 0.3, and a ratio of said absorbancy to an absorbancy of said support plus said backing layer in 450 nm is not less than 0.2.

2. The photographic material of claim 1, wherein said absorbency of said support plus said backing layer in the maximum wavelength of the spectral absorption of said desensitizing dye is not less than 0.5.

3. The photographic material of claim 1, wherein said desensitizing dye is added in an amount of 1 to 1,000 mg per mol of silver halide.

4. The photographic material of claim 3, wherein said desensitizing dye is added in an amount of 5 to 300 mg per mol of silver halide.

5. The photographic material of claim 1, wherein said rhodium salt is added in an amount of $2\times10^{-6}$ mol per mol of silver halide.

6. The photographic material of claim 3, wherein said desensitizing dye comprises a compound which has a positive sum of a cathodic potential and an anodic potential in polarography.

* * * * *